United States Patent [19]

Looney

[11] Patent Number: 4,639,121

[45] Date of Patent: Jan. 27, 1987

[54] DOCUMENT REGISTRATION SYSTEM

[75] Inventor: John H. Looney, Fairport, N.Y.

[73] Assignee: Xerox Corporation, Stamford, Conn.

[21] Appl. No.: 748,071

[22] Filed: Jun. 24, 1985

[51] Int. Cl.[4] ..... G03G 15/00

[52] U.S. Cl. ..... 355/14 R; 355/14 SH; 355/55

[58] Field of Search ..... 355/14 SH, 14 R, 75, 355/55–57, 60

[56] References Cited

U.S. PATENT DOCUMENTS

| | | | |
|---|---|---|---|
| 4,077,710 | 3/1978 | Ward et al. | 355/3 R |
| 4,139,298 | 2/1979 | Tani | 355/8 |
| 4,209,248 | 6/1980 | Gibson et al. | 355/8 |
| 4,353,643 | 10/1982 | Statt | 355/57 |
| 4,483,608 | 11/1984 | Satoh | 355/57 |
| 4,585,332 | 4/1986 | Shenoy | 355/14 SH |

FOREIGN PATENT DOCUMENTS

| | | |
|---|---|---|
| 2557385 | 6/1976 | Fed. Rep. of Germany . |
| 2757850 | 6/1979 | Fed. Rep. of Germany . |
| 56-59263 | 5/1981 | Japan . |

*Primary Examiner*—R. L. Moses

[57] ABSTRACT

The present invention is directed towards an optical scanning system for an electrophotograhic printing machine wherein a lens control system is provided to enable lens movement independent of lens movement which occurs during magnification changes. The lens carriage is adapted to be independently driven in one or two directions dependent on the mode of operation selected by the operator and under the control of a system controller which analyzes the inputs which determine lens position (open platen or document feeder mode, output copy size, magnification).

8 Claims, 5 Drawing Figures

CONTROLLER
58
MAGNIFICATION
DOCUMENT HANDLING SELECT
CONTROLS
35
D.C. STEPPING MOTOR
56, 57
34
52
20
54
82'
62
64
C
67
50
51
48
60
68
66
70
30
40
44
45
B
28
22
71
82
42
43
F
16
D
A
18
12
46
48
36
10
E
72

DOCUMENT REGISTRATION SYSTEM

The present invention relates generally to an electrophotographic document reproduction machine and, more specifically, to an optical system for enabling document and copy registration in a direction perpendicular to the process direction.

In a typical document reproduction machine, a document is placed on a transparent platen support and aligned against a registration edge either by a fiducial mark or by a mechanical stop. A horizontal registration edge at the platen has been found to be the most convenient orientation for an operator. This position serves not only to register a document but also to deskew it. The document is then exposed and an image projected onto a photoreceptor surface. The aligned document edge ideally coincides with a corresponding edge of the copy sheet upon which the developed image is transferred.

The above-described registration is referred to as an edge-registered system. A characteristic of an edge-registered system is that images formed at the photoreceptor are asymmetrical to the photoreceptor centerline. This is due to the offsets produced by reproducing documents of varying heights. This asymmetry creates a burden for the downstream process stations which develop the latent image, align copy sheets at a transfer position and fuse the transferred image to the copy sheet. It is therefore desirable to use a document registration system in which the document image is symmetrically formed about the photoreceptor centerline. This is referred to as a center-registered system. Heretofore, this type of system required locating a vertical guide at either the right or left edge of the document platen. The operator, aided by a fiducial marker, must then estimate document registration. This procedure is, necessarily, imprecise.

A further disadvantage with previous edge and center-registered systems for documents is that the alignment edges must be retracted or removed when the reproduction machine is operating in a document handling mode since the documents might be damaged by collision with these edges.

It is therefore one object of the present invention to provide for edge-to-edge registration of a document to the copy while maintaining the center of the exposed document image along a photoreceptor centerline. It is a further object to maintain this registration through at least two registration edge positions on the platen and through a continuous magnification range.

These objects are accomplished by providing control means to ascertain the system registration, magnification and copy paper height and to move a projection lens in a direction perpendicular to the optical axis (perpendicular to the process direction) so as to maintain a centrally aligned latent image on the photoreceptor. More particularly, in one embodiment, the invention is directed to a document reproduction machine including:

a transparent platen for supporting a document to be reproduced, said platen having a first horizontal edge registration position associated with a first mode of operation and a second horizontal edge-registration position associated with a second mode of operation, means for generating an electrical signal indicative of a said first or second registration position, an illumination scan assembly for scanning said document, an optical system for forming latent images of said scanned document on a photoreceptor surface moving in a process direction, said optical system including a movable projection lens, a developing station for developing said latent images, copy sheet feeding means adapted to convey copy sheets to a transfer station where said developed images are transferred to said copy sheet, means associated with said copy sheet feeding means for generating electrical signals indicative of a specific copy sheet size and orientation, and control means adapted to operate upon said electrical signals corresponding to registration position and copy sheet size and orientation and to move said lens in a direction perpendicular to said process direction so as to maintain a desired centerline and edge registration position at said photoreceptor surface.

DRAWINGS

Figure 1:
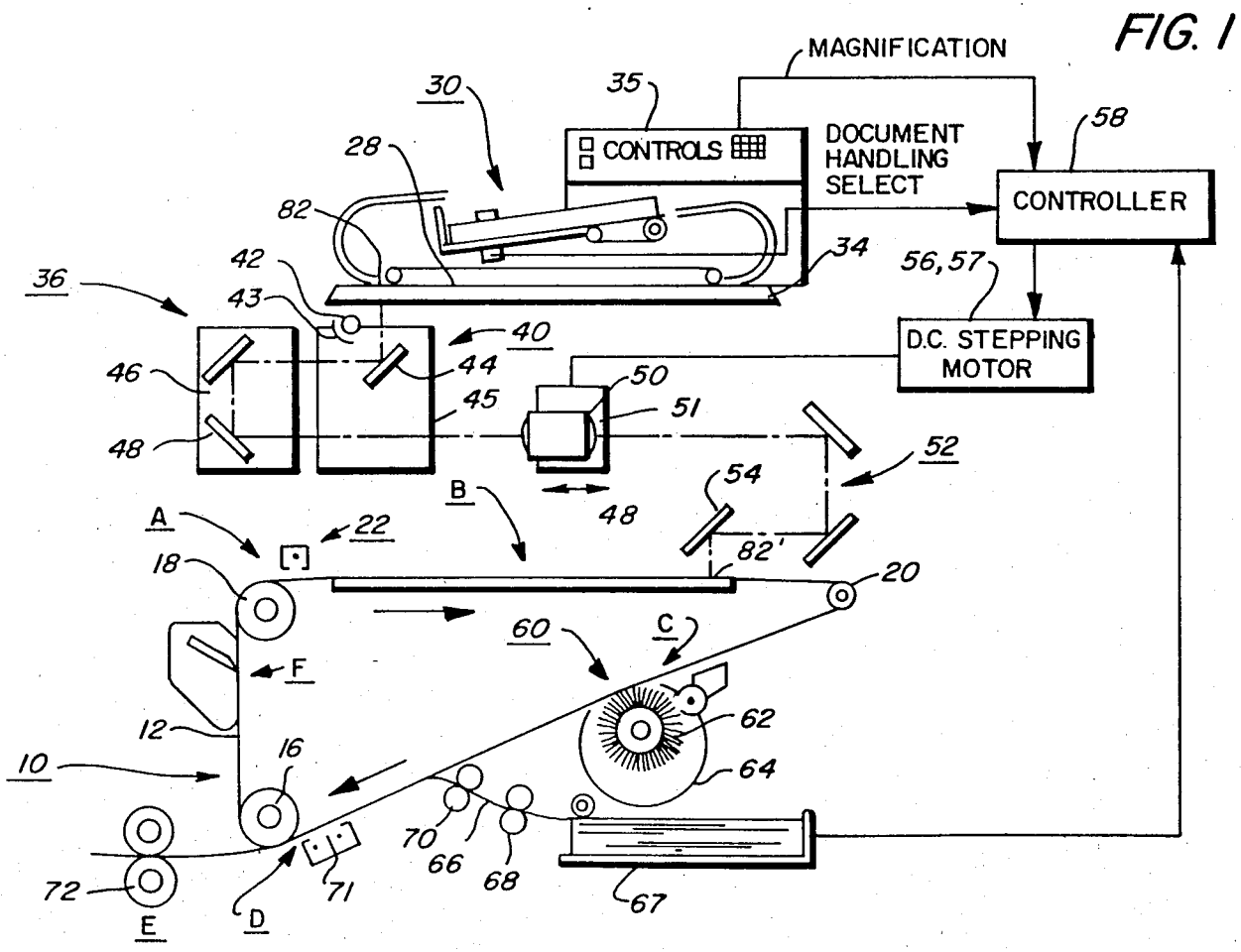
FIG. 1 is a front view of an electrophotographic printing machine having an optical system utilizing the lens of the present invention.

For an understanding of the features of the present invention, reference is made to the drawings. FIG. 1 schematically depicts the various components of an illustrative electrophotographic reproduction machine incorporating the movable lens and associated control and drive system of the present invention. It will become apparent from the following discussion that this lens and control and drive system is equally well suited for use in a wide variety of electrophotographic reproduction machines and is not necessarily limited in its application to the particular embodiment shown herein.

Inasmuch as the art of electrophotographic printing is well known, the various processing stations employed in the FIG. 1 printing machine will be shown hereinafter schematically and their operation described briefly with reference thereto.

Turning now to FIG. 1, the electrophotographic printing machine uses a photoreceptor belt 10 having a photoconductive surface 12 formed on a conductive substrate. Preferably, belt 12 has characteristics disclosed in U.S. Pat. No. 4,265,990 whose contents are hereby incorporated by reference. Belt 10 moves in the indicated process direction, advancing sequentially through the various xerographic process stations. The belt is entrained about drive roller 18 and tension rollers 16, 20. Roller 18 is driven by conventional motor means, not shown.

with continued reference to FIG. 1, a portion of belt 10 passes through charging station A where a corona generating device, indicated generally by the reference numeral 22, charges photoconductive surface 12 to a relatively high, substantially uniform, negative potential.

As belt 10 continues to advance, the charged portion of surface 12 moves into exposure station B. An original document 28 is positioned, either manually, or by a document feeder mechanism indicated generally by the reference numeral 30 on the surface of a transparent platen 34. Mode selection is made at control panel 35. Optics assembly 36 contains the optical components which incrementally scan-illuminate the document and project a reflected image onto surface 12 of belt 10. Shown schematically, these optical components comprise an illumination scan assembly 40, comprising illumination lamp 42, associated reflector 43 and full rate scan mirror 44, all three components mounted on a scan carriage 45. The carriage ends are adapted to ride along guide rails (not shown) so as to travel along a path parallel to and beneath, the platen. Lamp 42, during its scan travel, illuminates incremental line portions of document 28. The reflected image is reflected by scan mirror 44 to corner mirror assembly 46 on a second scan carriage 48, moving at one half the rate of carriage 45. The image, folded by mirror assembly 46, enters lens 50. The document image is projected through lens 50, mounted on lens carriage 51, and reflected and folded by a second corner mirror assembly 52 and belt mirror 54, both moving at a predetermined relationship with respect to each other so as to maintain the required rear conjugate. The image formed on surface 12 is an electrostatic latent image corresponding to the informational areas contained within original document 28. Lens 50, mounted on lens carriage 51 is movable along the optical path and/or in a lateral direction perpendicular to the optical path (into and out of the plane of the drawing), by dc stepper motors 57, 56, respectively, controlled by operation of system controller 58.

At development station C, a magnetic brush development system, indicated generally by the reference numeral 60, advances an insulating development material into contact with the electrostatic latent image. Preferably, magnetic brush development system 60 includes a developer roller 62 within a housing 64. Roller 62 transports a brush of developer material comprising magnetic carrier granules and toner particles into contact with belt 10. Roller 62 is positioned so that the brush of developer material deforms belt 10 in an arc with the belt conforming, at least partially, to the configuration of the developer material. The thickness of the layer of developer material adhering to developer roller 62 is adjustable. The electrostatic latent image attracts the toner particles from the carrier granules forming a toner powder image on photoconductive surface 12. The detailed structure of the magnetic brush development system is more fully disclosed in U.S. Pat. No. 4,397,264, whose contents are hereby incorporated by reference.

Continuing with the system description, an output copy sheet 66 is taken from a supply tray 67. The tray, and therefore each sheet, is centrally aligned with belt 10. An electrical signal proportional to the sheet size and tray location is sent to controller 58 for purposes to be discussed below. The sheets are conveyed from the tray to transfer station D by feed rollers 68, 70. Transfer station D includes a corona generating device 71 which sprays ions onto the backside of sheet 66, thereby attracting the toner powder image from surface 12 to sheet 66. After transfer, the sheet advances to fusing station E where a fusing roller assembly 72 affixes the transferred powder image. After fusing, the copy sheet 66 advances to an output tray (not shown) for subsequent removal by the operator.

After the sheet of support material is separated from belt 10, the residual toner particles and the toner particles of developed test patch areas are removed at cleaning station F.

Subsequent to cleaning, a discharge lamp, not shown, floods surface 12 with light to dissipate any residual charge remaining thereon prior to the charging thereof for the next imaging cycle.

Figure 2:
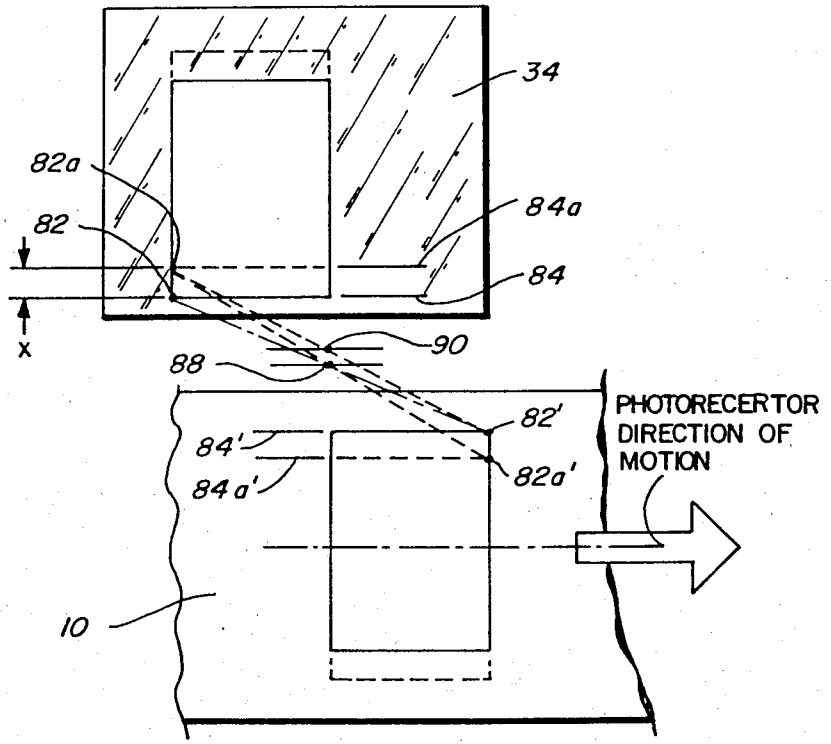
FIG. 2 is a top perspective view of the document platen and photoreceptor belt showing the lens movement required to maintain registration with document position change.

According to one aspect of the invention, the lens 50 can be moved independent of any change in system magnification, to accomplish certain specified functions. As one example of such a function, consider the situation shown in FIG. 1 where the document may have alternate registration positions on the platen, depending on whether the copy is being made from a manually positioned document (registration position 82) or from a document feeder (registration position 82A). FIG. 2 shows a top perspective view of platen 34 and belt 10 with an $8\frac{1}{2}'' \times 11''$ document placed with its corner in registration position 82 (document shown in solid line) and position 82A (document shown in dotted line). The displacement, distance X, between the two registration edges, for this example, is assumed to be 4 mm. A manually positioned document is registered at fiducial mark 82 and along registration edge 84. Assuming a 1X mode, the document is scanned by the optics (mirrors and lamp omitted for clarity) and a latent image projected onto the surface 12 of belt 10. The lens is positioned to center the image on the centerline of belt 10. Corner 82 is registered at corner 82' and registration edge 84 at edge 84'. The latent image is developed and letter-size copy sheets 66, ($8\frac{1}{2}$ by 11 inches or 21.6 by 27.9 cm. size) are fed from paper tray 67 so as to have the developed image transferred thereto.

Assume next that the mode of operation is changed and a quantity of letter-size original documents are to be conveyed to the platen by means of the document feeder mechanism 30 and copied at unity magnification. In this mode of operation, the documents are prevented from contacting edge 84 and are registered at a second fiduciary mark 82A and along a second registration edge 84A. The new position of the document is shown in dotted form. As indicated above, the distance X separating the two registration edges is 4 mm. The document image, if no compensating action were taken, would be projected onto the photoreceptor, to produce a centrally misaligned latent image with its corner at 82A' and along an edge 84A'. To properly transfer the developed image would require an adjustment in the output sheet position to match the new image location.

In order to maintain the desired control edge registration position and according to the principles of the present invention, the lens, controlled by controller 58 is moved from centerline position 88 to position 90 (dotted) a distance of 2 mm laterally, and in a direction perpendicular to the photoreceptor movement. This movement, initiated upon selection of the document feeder mode of operation, compensates for the new document registration position by projecting the images to the centerized position on surface 12 coincident with corner 82' and edge 84'.

Thus, for changing modes of operation for documents and copies of the same size, lens movement is controlled by signals corresponding to the change from manual to document handling mode and vice versa. The lens position is also changed when copy sheet sizes are changed. The lens movement will result in the lens maintaining a central position along the light path connecting the near document edge and the far edge of a centrally realigned copy. When both the mode of operation and the document size are changed, the lens movement is governed by inputs from both the registration mode change and the paper tray selection.

Figure 3:
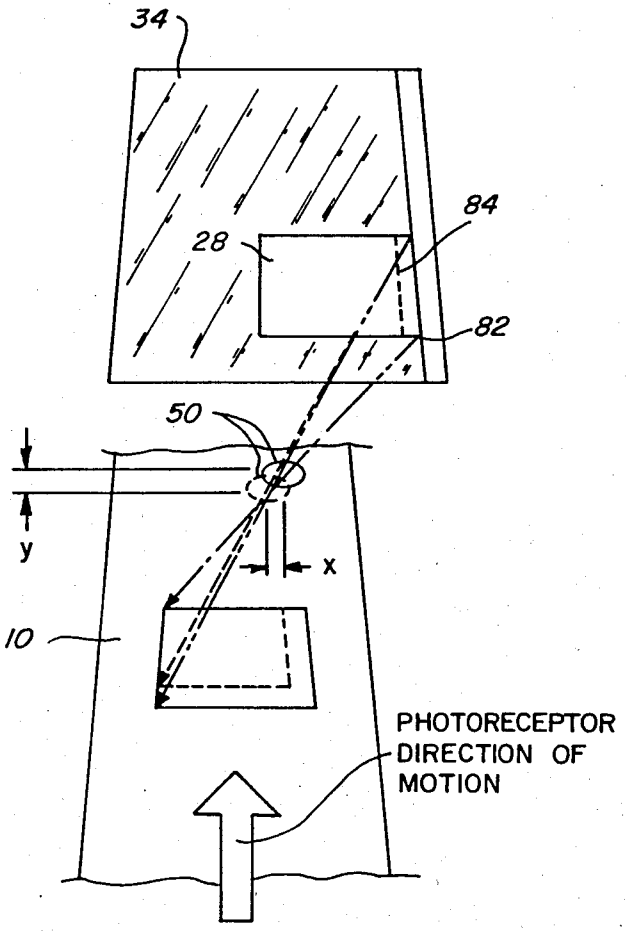
FIG. 3 is a side perspective view of the lens being moved through magnification positions while maintaining registration.

According to a still further aspect of the present invention, the lateral displacement of the lens is combined with displacement along the optical axis during magnification changes. Referring to FIG. 3, a letter-size document is shown being copied in a manual mode. Lens 50 is moved from the dotted line (1X) position along the optical axis a distance Y and a distance X in a lateral direction. The X displacement moves the lens closer to the photoreceptor to provide the required magnification, while the Y displacement maintains the front edge, document center aligned copy registration.

Figure 4:
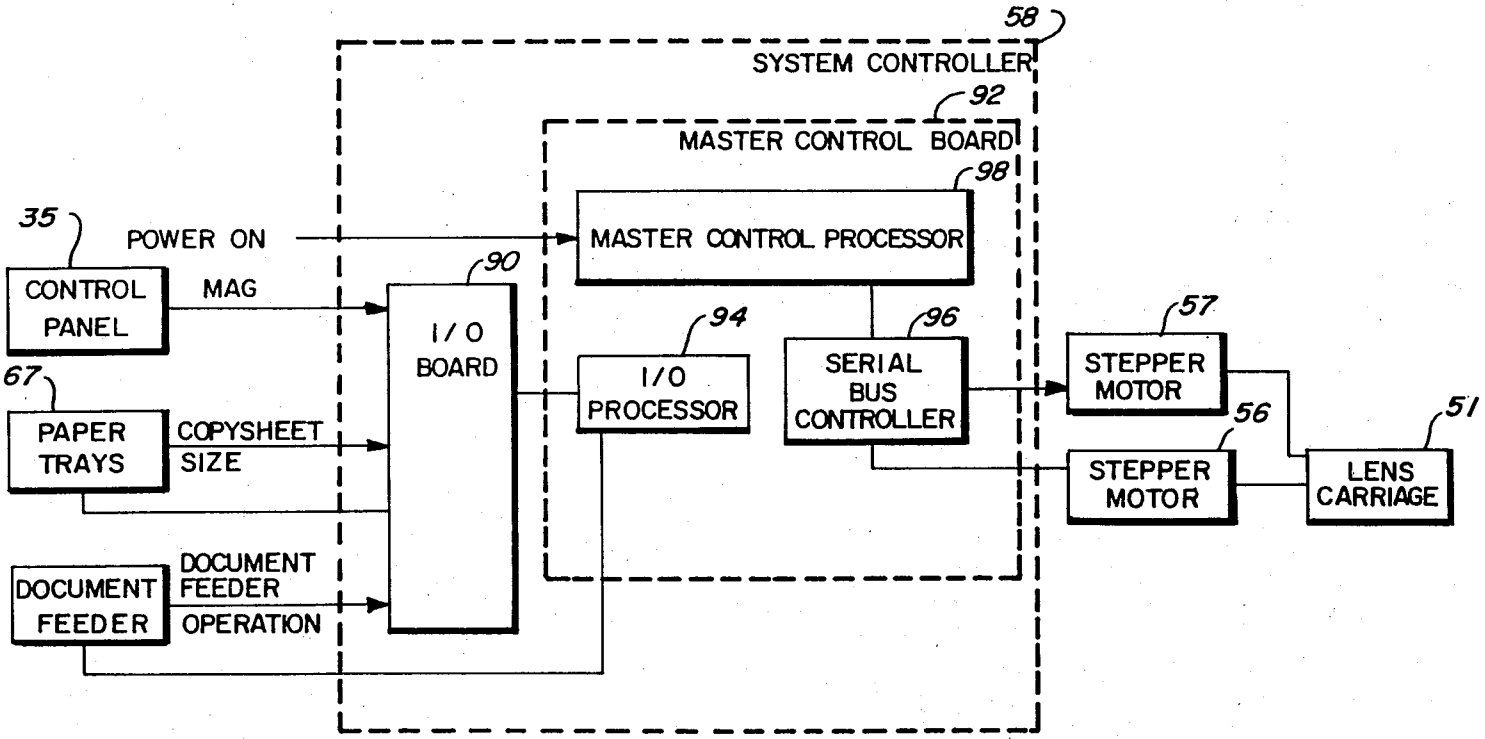
FIG. 4 is a block diagram of the circuit which controls the lens movement.

Turning next to the control circuitry which provides the required lens increments, FIG. 4 is a block diagram of the system controller 58. Controller 58 consists of Input/Output Board 90 and a master control board 92, comprising Input/Output processor 94, a serial bus controller 96 and master control processor 98. Processor 98 can be Intel Model 8585, programmed to perform the described functions. Input signals from the control panel and paper trays are converted by I/O Board 90, sent to I/O processor 94 and then to master control processor 98. Operation of the lens carriage is controlled by processor 98 via controller 96.

The selection of a desired magnification is conventionally made at control panel 35. The enabled switches provide a signal to the controller indicative of that selected magnification. A change in magnification results in output signals to both stepper motor 57 (for optical path translation) or stepper motor 56 (for lateral, perpendicular to process direction) motion. A Nippon Electric Motors Model STA 401 motor has been found satisfactory to perform the stepping operation. A change of operation from manual document positioning to document feeder operation is evaluated by appropriate signals, or absence thereof, from the document feeder activation swtich. Appropriate signals are sent to stepper motor 56 to move the lens laterally to the new position. The signals from copy sheet trays 67 are provided by actuation of a particular copy selection switch enabled by loading a particular copy paper size into the tray. Thus, the signal to the controller is indicative of the size of the copy sheet onto which the document image is to be copied.

Figure 5:
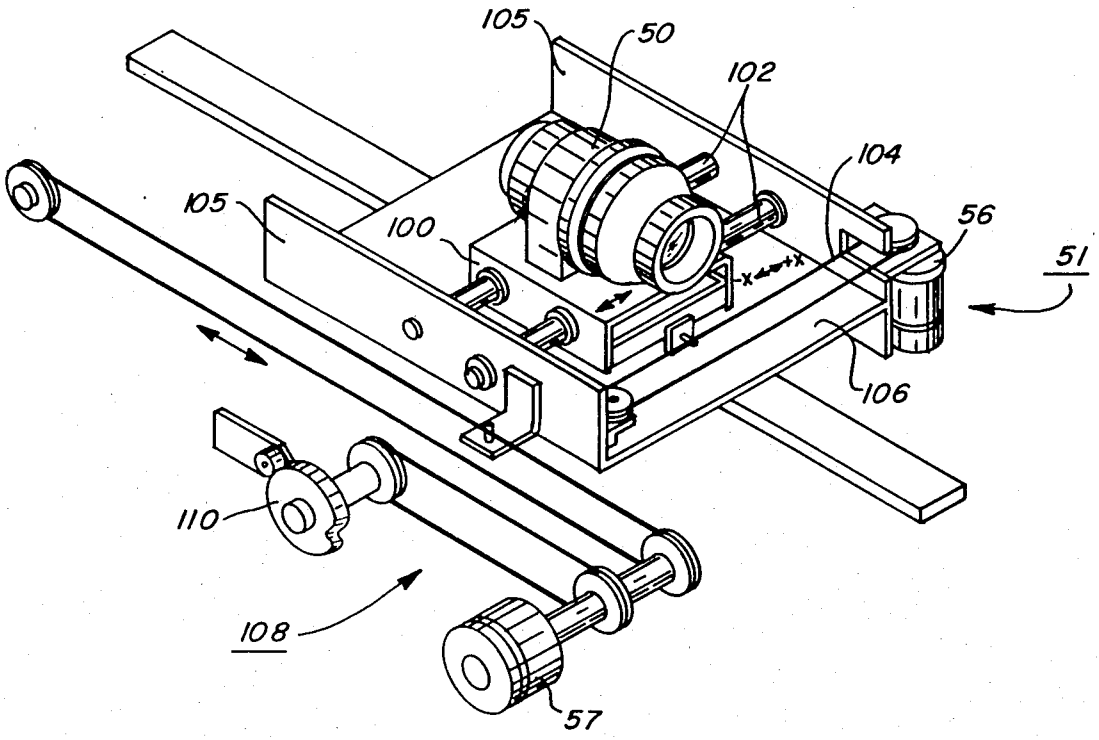
FIG. 5 is a schematic drawing of the carriage upon which the lens is mounted.

Turning now to a specific embodiment of the lens carriage 51, reference is made to the FIG. 5. As shown, lens 50 is mounted on a first carriage 100 adapted to move in the +X, −X direction along guide rails 102. The carriage 100 is driven by a pulley/cable arrangement 104 which, in turn is driven by dc stepper motor 56. Guide rails 102 are fixed mounted to frame 105 of a second lens carriage 106. Carriage 106 is adapted to move in the +Y, −Y direction (along the optical axis for magnification changes). The carriage 106 is driven by a pulley/cable arrangement 108 which, in turn, is driven by a stepper motor 57. Inputs to the stepper motors are derived as explained above.

It is believed that the foregoing description is sufficient for purposes of the present application to illustrate the general operation of an electrophotographic printing machine incorporating the features of the present invention therein.

The invention has been shown, in a first aspect, to reside in enabling lens motion independent of magnification changes. This separation of the two motions is highly advantageous in a document reproduction machine in which a centrally registered image is to be maintained at the photoreceptor. For example, an edge-justified fuser roll system may be adapted for one paper width with other widths being wrinkle prone. The present invention, providing centrally-registered paper, can accommodate a variety of paper widths using a symmetrically loaded fuser roll.

Other modifications to the above-described embodiments may be maintained within the purview of the present invention. For example, as described above, the near edge of the document is made to correspond to the far edge of the latent image. The addition of suitably positioned platen sensors to provide information on the document's far edge position enables an embodiment where the top edge of the document is aligned to the top edge of the latent image. This provides space at the bottom of the image for annotation.

What is claimed is:

1. An imaging system for a document reproduction machine including:

a transparent platen for supporting a document to be reproduced, said platen having a first horizontal edge registration position associated with a first mode of operation and a second horizontal edge registration position associated with a second mode of operation, means for generating an electrical signal indicative of said first or second registration position, an illumination scan assembly for scanning said document, an optical system for forming latent images of said scanned document on a photoreceptor surface moving in a process direction, said optical system including a movable projection lens, and control means adapted to receive said electrical signals corresponding to registration position and to move said lens in a direction perpendicular to said process direction so as to maintain a centered and edge-registered position of said latent image on said photoreceptor.

2. The imaging system of claim 1 further including means for generating signals indicative of a copy size, said control means further adapted to receive said electrical signals representative of copy size and to move said lens in said perpendicular direction.

3. The imaging system of claim 1 further including means for generating electrical signals indicative of the magnification at which the document is to be reproduced, said control means further adapted to receive said magnification signals and to move said lens in a direction along the optical path to a position corresponding to the magnification selected.

4. An imaging system for a document reproduction machine including:

a transparent platen for supporting a document to be reproduced, said platen having a first horizontal edge-registration position associated with a first manual mode of operation and a second horizontal edge-registration position associated with a second document feeder mode of operation, an illumination source for illuminating said document (in a reproduction mode of operation), an optical projection system for projecting images reflected from said document onto a photosensitive plane, said optical system including a lens, and means to move said lens coincident with a change in any of said platen registration positions so as to maintain a desired centerline and edge registration position at said photosensitive surface.

5. A document reproduction system including:

a transparent platen for supporting a document to be reproduced, said platen having a first horizontal edge registration position associated with a first mode of operation and a second horizontal edge registration position associated with a second mode of operation, means for generating an electrical signal indicative of a said first or second registration position, an illumination scan assembly for scanning said document, an optical system for forming latent images of said scanned document on a photoreceptor surface moving in a process direction, said optical system including a movable projection lens, a developing station for developing said latent images, copy sheet feeding means adapted to convey copy sheets to a transfer station where said developed images are transferred to said copy sheet, means associated with said copy sheet feeding means for generating electrical signals indicative of a specific copy sheet size and orientation, and control means adapted to operate upon said electrical signals corresponding to registration position and copy sheet size and orientation and to move said lens in a direction perpendicular to said process direction so as to maintain a desired centerline and edge registration position at said photoreceptor surface.

6. The system of claim 5 wherein said first mode of operation is a manual mode and said second mode is a document feeder mode.

7. The system of claim 5 further including means for generating electrical signals indicative of the magnification value at which the document is to be reproduced, said control means further adapted to receive said magnification signals and to move said lens along the optical path to a position corresponding to the selected magnification.

8. The optical system of claim 5 wherein said lens is mounted on a carriage adapted to be movable along the optical path and in a direction perpendicular to the process direction.

* * * * *